US006666483B2

(12) United States Patent
Baniak et al.

(10) Patent No.: US 6,666,483 B2
(45) Date of Patent: Dec. 23, 2003

(54) HOOD LATCH WITH SELF-RETRACTING SECONDARY LATCH RELEASE ARM

(75) Inventors: Grzegorz Baniak, Etobicoke (CA); Kris Tomaszewski, Newmarket (CA); Dikran Ghorghorian, Scarborough (CA)

(73) Assignee: Atoma International Corp, Newmarket (CA)

( * ) Notice: Subject to any disclaimer, the term of this patent is extended or adjusted under 35 U.S.C. 154(b) by 0 days.

(21) Appl. No.: 10/169,882

(22) PCT Filed: Jan. 15, 2001

(86) PCT No.: PCT/CA01/00121

§ 371 (c)(1),
(2), (4) Date: Nov. 4, 2002

(87) PCT Pub. No.: WO01/51745

PCT Pub. Date: Jul. 19, 2001

(65) Prior Publication Data

US 2003/0122382 A1 Jul. 3, 2003

Related U.S. Application Data

(60) Provisional application No. 60/176,222, filed on Jan. 14, 2000.

(51) Int. Cl.[7] ..... E05C 19/10

(52) U.S. Cl. ..... 292/123; 292/336.3; 292/DIG. 14; 292/216

(58) Field of Search ..... 292/123, 216, 292/109, 110, 113, 126, 336.3, DIG. 14

(56) References Cited

U.S. PATENT DOCUMENTS 4,756,562 A * 7/1988 Foster et al.
5,000,493 A * 3/1991 Bastien
5,118,146 A * 6/1992 Watanuki ..... 292/216
5,141,265 A * 8/1992 Claar ..... 292/30
6,109,670 A * 8/2000 Tomaszewski ..... 292/216
6,149,210 A * 11/2000 Hunt ..... 292/216

FOREIGN PATENT DOCUMENTS

DE 198 23 574 A1 * 12/1999
WO WO 98/26144 * 12/1997
WO WO 99/11892 * 9/1998

* cited by examiner

*Primary Examiner*—Gary Estremsky
(74) *Attorney, Agent, or Firm*—Clark Hill PLC

(57) ABSTRACT

A latch assembly (10) has a housing having a mouth. A ratchet (12) is pivotally mounted to the housing and is movable to cooperate with the mouth to pivot between an open condition, a primary closed condition and a secondary closed condition for receiving, engaging and cinching a keeper of a striker. The ratchet (12) is biased to the open condition. A pivotally mounted pawl (40) is biased into engagement with the ratchet for releasably retaining the ratchet in the primary closed condition. A secondary release arm (20) is mounted to rotate about a first axis and a second axis. The secondary release arm (20) is rotatable about the first axis between a retracted position and an extended position, and is rotatable out the second axis between an engaging position and a disengaging position. The secondary release arm (20) is biased to the retracted position and biased to the engaging position. The secondary release arm (20) interengages with the ratchet (12) for coupled movement therewith from the primary closed condition to the secondary closed condition effecting movement of the secondary release arm (20) from the retracted position to the extended position upon the pawl (40) being rotated to disengage from the ratchet (12). Upon moving the secondary release arm (20) from the engaging position to the disengaging position, the secondary release arm (20) disengages from the ratchet (12) for independent movement enabling the ratchet (12) to rotate from the secondary closed condition to the open condition and back to the primary closed condition. The secondary release arm (20) also rotates from the extended position to the retracted position.

11 Claims, 3 Drawing Sheets

HOOD LATCH WITH SELF-RETRACTING SECONDARY LATCH RELEASE ARM

This application claims the benefit of Provisional application No. 60/176,222 filed Jan. 14, 2000.

FIELD OF INVENTION

This invention relates to a hood latch for a vehicle. In particular, this invention relates to a hood latch having a self-retracting secondary arm.

BACKGROUND OF INVENTION

Vehicle hood latch systems are well known in the art. Typically, a vehicle hood or trunk deck will have a latch for engaging and cinching onto a striker. The latch will have a rotatably mounted ratchet engaging a pawl in a ratchet relation. The ratchet cooperates with a mouth of the housing to pivot between an open and closed condition for receiving, engaging and cinching a keeper of a striker. The pawl retains the ratchet in the closed and cinched conditions.

Hood latches are required to have a secondary latching mechanism and a primary latching mechanism. The primary latching mechanism is operably from inside the vehicle, normally under the dashboard. A secondary latching is only operable from the outside. The secondary release lever is accessible only after the primary latching mechanism has been deployed, but is usually in a deployable position even though it is not accessible. In many cases, the location of the arm is difficult to find requiring the operator to probe blindly or bend over to look for the arm.

It is known to provide a release lever on the secondary latching mechanism that is presented only upon the release of the primary latch. Examples of such latch mechanism are described in U.S. Pat. Nos. 4,961,601; 4,991,884; 5,000,493 and 5,141,265. However, such mechanisms require complicated linkages and levers, adding costs to the latch. As a result, the use of self presenting secondary release arms has been limited.

SUMMARY OF THE INVENTION

The disadvantages of the prior art may be overcome by providing a hood latch assembly for a vehicle having a simple mechanism for self presenting a secondary release arm upon releasing of the primary release and which retracts upon secondary release of the hood.

It is desirable to provide a hood latch assembly having a retracting secondary release that is retracted independently of the closing of the hood minimizing inertial forces on the secondary release lever.

According to one aspect of the invention, there is provided a latch assembly that has a housing having a mouth. A ratchet is pivotally mounted to the housing and is movable to cooperate with the mouth to pivot between an open condition, a primary closed condition and a secondary closed condition for receiving, engaging and cinching a keeper of a striker. The ratchet is biased to the open condition. A pivotally mounted pawl is biased into engagement with the ratchet for releasably retaining the ratchet in the primary closed condition. A secondary release arm is mounted to rotate about a first axis and a second axis. The secondary release arm is rotatable about the first axis between a retracted position and an extended position, and is rotatable about the second axis between an engaging position and a disengaging position. The secondary release arm is biased to the retracted position and biased to the engaging position. The secondary release arm interengages with the ratchet for coupled movement therewith from the primary closed condition to the secondary closed condition effecting movement of the secondary release arm from the retracted position to the extended position upon the pawl being rotated to disengage from the ratchet. Upon moving the secondary release arm from the engaging position to the disengaging position, the secondary release arm disengages from the ratchet for independent movement enabling the ratchet to rotate from the secondary closed condition to the open condition and back to the primary closed condition. The secondary release arm also rotates from the extended position to the retracted position.

According to another aspect of the invention, there is provided a latch assembly having a secondary release arm that includes a plate commonly mounted for pivotal movement therewith. The plate interengaging with a ratchet. The secondary release arm is pivotally mounted in an over center and overlapping relation with the plate, enabling the plate to pivot without causing the secondary release lever to pivot, and coupling the secondary release lever to effect pivoting of the plate.

DESCRIPTION OF THE DRAWINGS

In drawings which illustrate embodiments of the invention.

DESCRIPTION OF THE INVENTION

Figure 1:
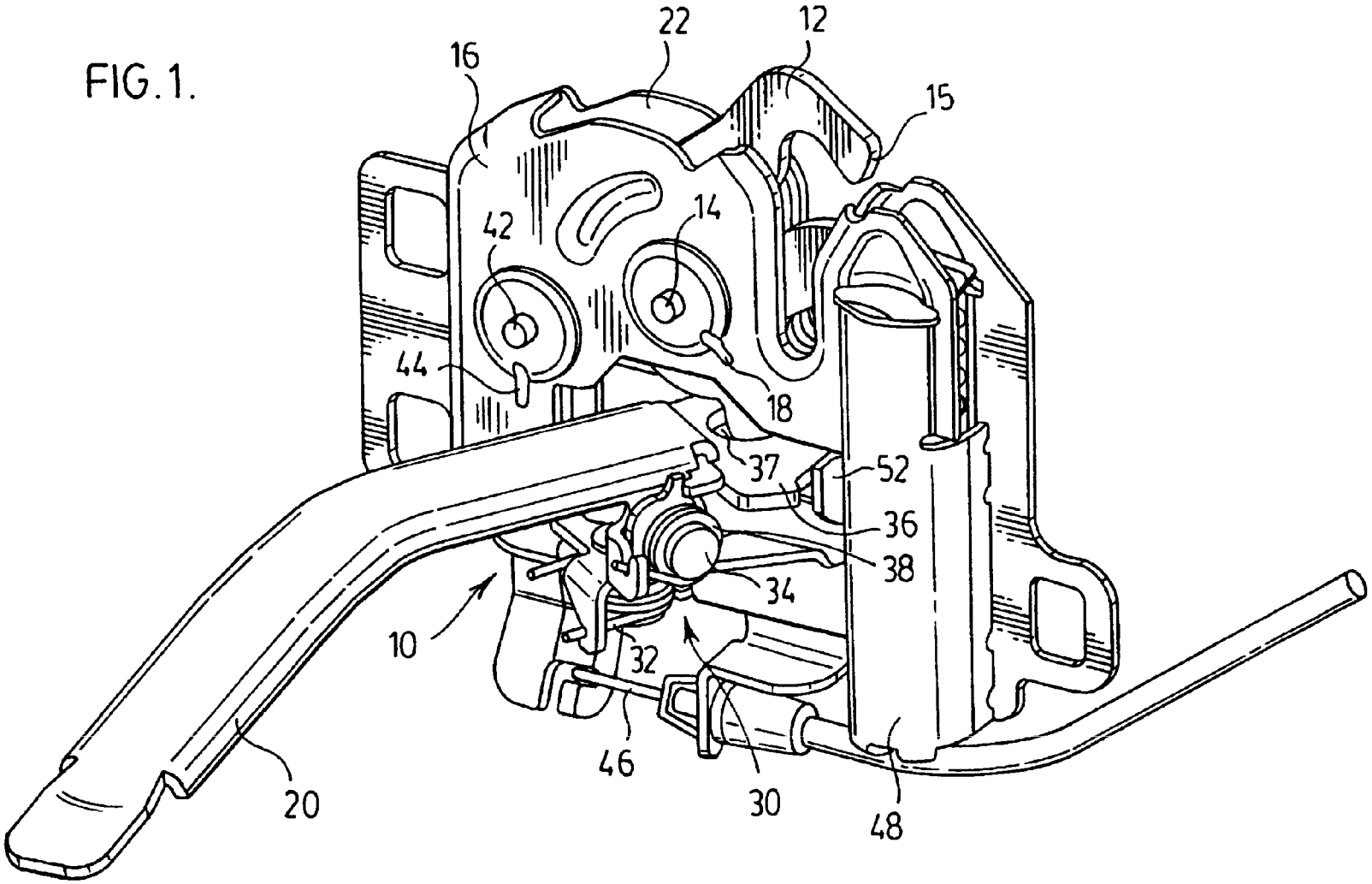
FIG. 1 is a perspective view of the latch assembly of the present invention.
Figure 2:
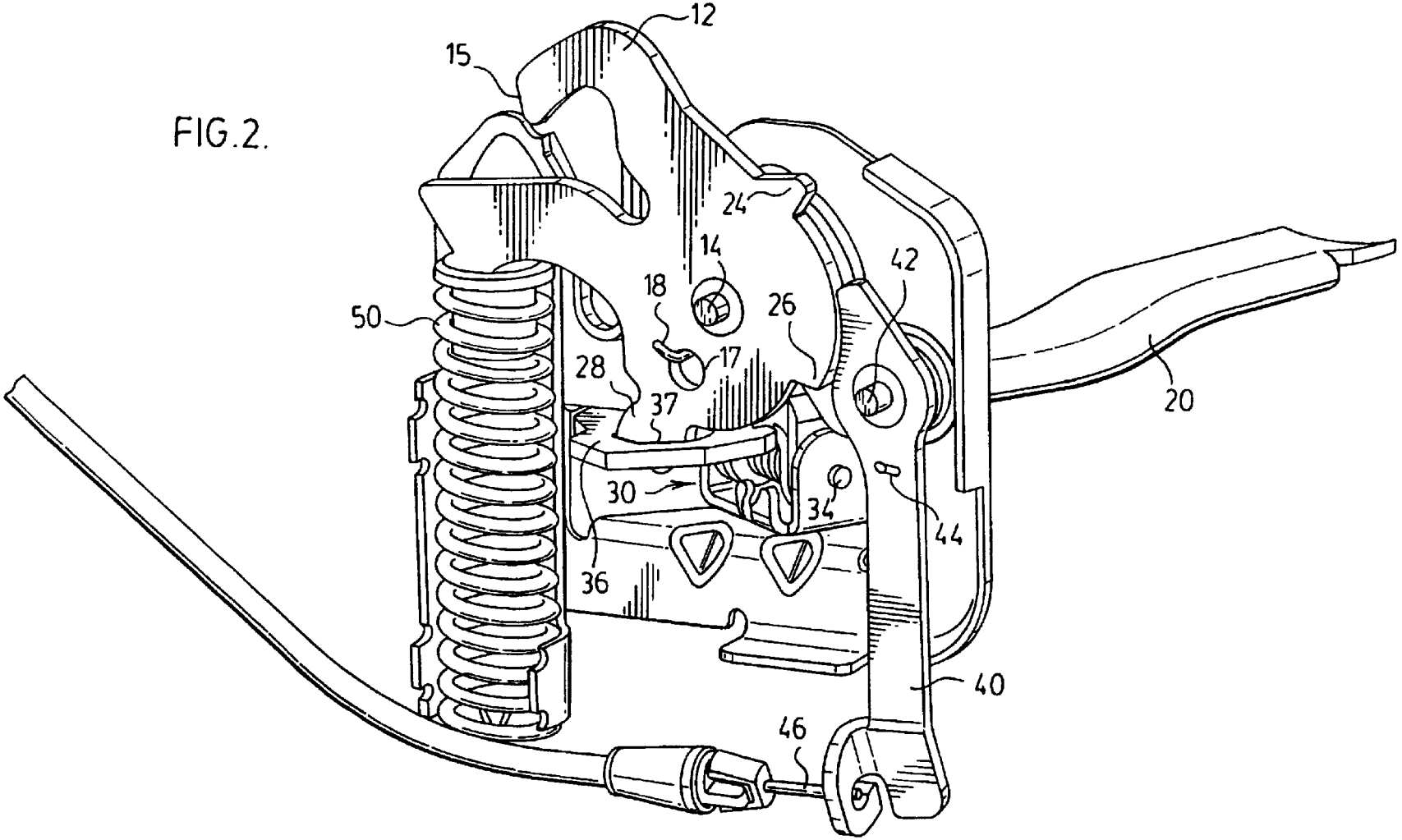
FIG. 2 is a perspective view of the reverse side of the latch assembly of FIG. 1, with the back plate removed.
Figure 3:
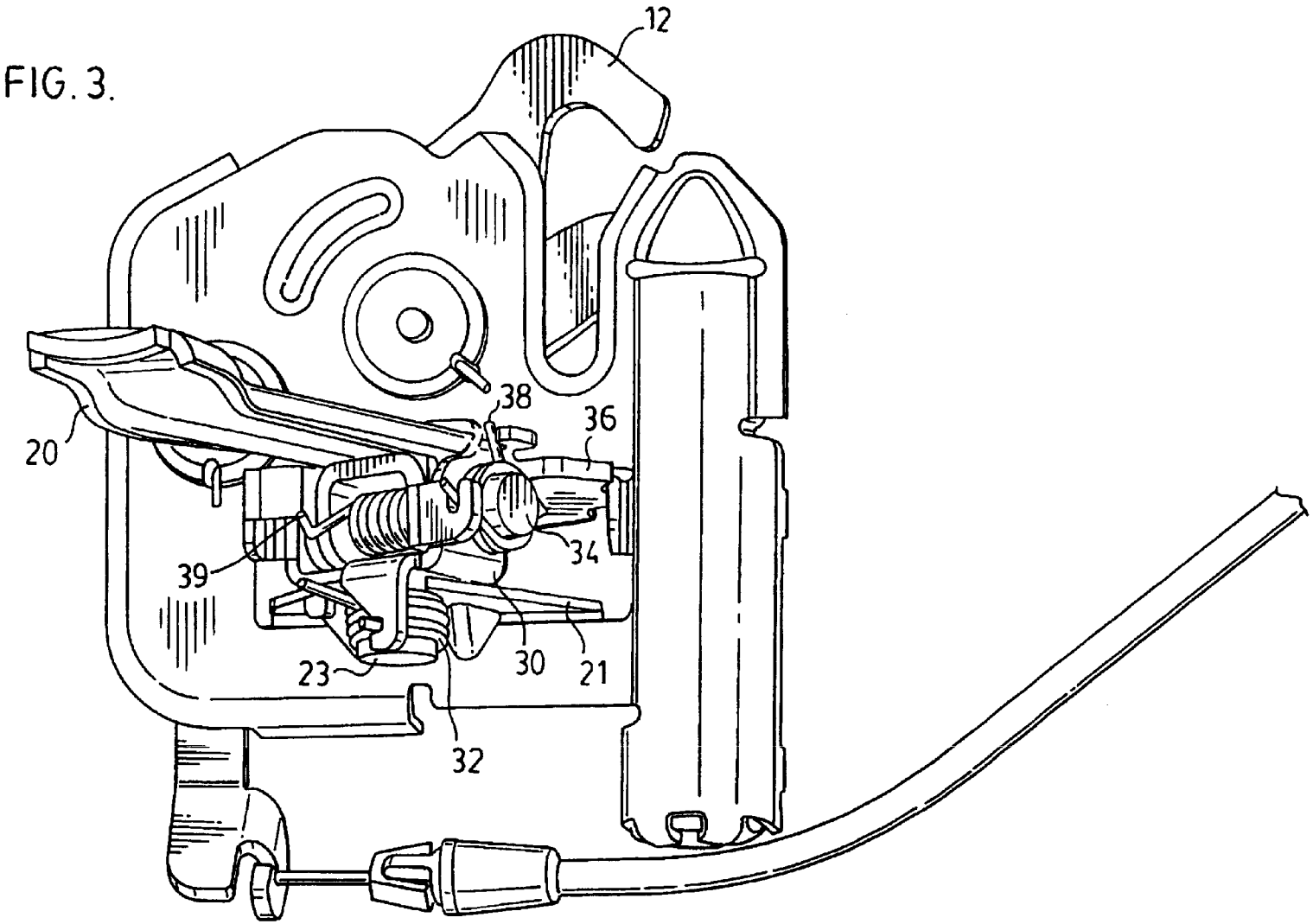
FIG. 3 is a perspective view of the latch assembly, similar to FIG. 2, but from a lower angle of view to illustrate the release lever mounting assembly.

Referring to FIGS. 1 and 2, the latch assembly 10 of the present invention generally has a ratchet or ratchet 12 which has a hook 15 and which is rotatable mounted on a pin 14 to pivot between an open condition, a secondary closed condition and a primary closed condition to grip a keeper of a striker. Spring 18 attaches to the ratchet 12 at aperture 17 and to housing 16 to bias ratchet 12 to a release position. Pin 14 extends between housing 16 and back plate 22.

Ratchet 12 has a series of detents 24 and 26 corresponding to the open condition and the primary closed condition. Ratchet 12 has a tab or tongue 28. Preferably, the leading edge of the tab 28 is contoured. Ratchet 12 cooperates with the mouth of the housing 16. Pawl 40 is biased to engage ratchet 12 in a ratchet relation. The ratchet 12 cooperates with a mouth of the housing 16 to pivot between the open and primary closed or latched condition for receiving, engaging and cinching a keeper of a striker. The pawl 40 retains the ratchet 12 in the latched condition.

Secondary release lever 20 is mounted on a mounting assembly to provide two degrees of movement. Release lever 20 has a U-shaped base that is received between arms of upwardly extending U-shaped pivot mount 30. Pivot 30 is pivotally mounted on flange 21 of housing 16 by pin 23 to rotate about a first axis, providing a side to side movement of the secondary release lever 20 and plate 36. Pivot pin 34 pivotally connects release lever 20 to the mounting assembly about a second axis to provide an up and down movement as will be explained later. Preferably the first axis is orthogonal to the second axis.

Spring 32 extends between flange 21 and U-shaped pivot 30 to bias the mounting assembly, including release lever 20, to the retracted position. In the retracted position, release lever 20 will be in the same general plane as the housing 16. U-shaped pivot mount 30 pivotally receives plate 36. Plate 36 has a U-shaped base that is fitted between the arms of the U-shaped pivot mount 30 and release lever 20. Plate 36 has an aperture 37 that is sized to receive tab 28 of ratchet 12.

Plate 36 and secondary release lever 20 has a common pivot. Preferably, secondary release lever 20 and plate 36 extend from opposite sides of the common pivot. Secondary release lever 20 extends in an over center and overlapping relation with plate 36 so that plate 36 may pivot independently of the secondary release lever 20, but not vice versa. In other words, plate 36 may pivot without causing release lever 20 to pivot, but pivoting of release lever 20 will cause pivoting of the plate 36.

Spring 38 extends between release lever 20 and plate 36 to bias plate 36 to cooperate with release lever 20. Spring 39 extends between the plate 36 and U-shaped mount 30 to bias the plate 36 upwardly for engagement with the ratchet 12.

The various elements have tabs for engaging the springs that make up the present invention. The tabs are positioned in a manner well known in the art to provide the requisite biasing as described herein.

Release pawl 40 is pivotally mounted on pin 42 that extends between the housing 16 and back plate 22. Spring 44 biases the pawl into engagement with the ratchet 12. Pawl 40 is connected to a release wire 46 in a manner well known in the art.

Housing 16 has a semi-tubular channel 48 which houses spring 50 which biases ratchet 12 to the release position.

In the release condition, the secondary release arm 20 is in the retracted condition. Upon closing the hood, the ratchet 12 receives a keeper mounted on the hood. A hood closing force will cause the ratchet 12 to rotate against the bias of spring 18 and 50 until release pawl 40 abuts against detent 26, securing the hood in the latched condition. Tab 28 of ratchet 12 will engage plate 36 and will urge the plate 36 to deflect against the bias of spring 38 until tab 28 is received within aperture 37.

Upon primary release of the ratchet 12 by retracting cable 46 from inside the vehicle, pawl 40 will rotate releasing ratchet 12 from detent 26. Since ratchet 12 is in engagement with the release lever 20, rotation of the ratchet 12 is a releasing direction will cause the release lever 20 to pivot from the retracted position to the secondary release position until the plate 36 contacts stop 52. In the secondary release position, the release lever 20 will extend forwardly of the latch assembly and thus accessible from the front of the vehicle. Upon urging the release lever in an upward direction, the plate 36 will be urged away from the ratchet 12 until tab 28 disengages from the aperture 37. The bias of spring 18 will rotate the ratchet 12 to the release condition, fully releasing the keeper and allowing the hood to be opened. Detent 24 will abut release pawl 40. Additionally, the bias of spring 32 will rotate the release lever 20 from the release position back to the retracted position.

The principal advantage of the present invention is that the retraction of the secondary release lever is not dependent on the closing of the hood.

The preceding specific embodiment is illustrative of the practice of the present invention. It is to be understood, however, that other expedients known or apparent to those skilled in the art or disclosed herein may be employed without departing from the scope of the invention.

What is claimed:

1. A latch assembly comprising:

a housing having a mouth, a ratchet pivotally mounted to the housing and movable to cooperate with the mouth to pivot between an open condition, a primary closed condition and a secondary closed condition for receiving, engaging and cinching a keeper of a striker, the ratchet biased to the open condition, a pivotally mounted pawl having biasing means for biasing the pawl into engagement with the ratchet for releasably retaining the ratchet in the primary closed condition, a secondary release arm mounted to rotate about a first axis and a second axis, said secondary release arm rotatable about said first axis between a retracted position and an extended position, said secondary release arm rotatable about said second axis between an engaging position and a disengaging position, said secondary release arm biased to the retracted position and biased to the engaging position, said secondary release arm interengaging with said ratchet for coupled movement therewith from the primary closed condition to the secondary closed condition effecting movement of said secondary release arm from the retracted position to said extended position upon said pawl being rotated to disengage from said ratchet, and upon moving said secondary release arm from said engaging position to said disengaging position, said secondary release arm disengages from said ratchet for independent movement enabling said ratchet to rotate from the secondary closed condition to the open condition and back to the primary closed condition, and enabling said secondary release arm to rotate from the extended position to the retracted position.

2. A latch assembly as claimed in claim 1 wherein said secondary release arm interengages with said ratchet upon said ratchet moving back to said primary closed condition.

3. A latch assembly as claimed in claim 2 wherein secondary release arm includes a plate commonly mounted for pivotal movement therewith for rotation about said second axis, said plate interengaging with said ratchet, said secondary release arm engages with said plate in an over center and overlapping relation enabling said plate to pivot without causing said secondary release lever to pivot, and coupling the secondary release lever to effect pivoting of the plate by said secondary release lever.

4. A latch assembly as claimed in claim 3 wherein said plate has an aperture and said ratchet has a tab positioned to interengage with said aperture when said ratchet moves back to said primary closed condition.

5. A latch assembly as claimed in claim 4 wherein said housing has a stop for limiting movement of said secondary release arm when said secondary release arm is in said extended position.

6. A latch assembly as claimed in claim 5 wherein said secondary release arm extends substantially parallel to said housing when in said retracted position and extends substantially perpendicular to said housing when in said extended position.

7. A latch assembly as claimed in claim 1 comprising a U-shaped mount pivotally mounted on said housing for rotating about said first axis, said secondary release arm pivotally mounting to said U-shaped member for rotating about said second axis.

8. A latch assembly as claimed in claim 7 wherein secondary release arm includes a plate commonly mounted for pivotal movement therewith for rotation about said second axis, said plate interengaging with said ratchet, said secondary release arm engages with said plate in an over center and overlapping relation enabling said plate to pivot without causing said secondary release lever to pivot, and coupling the secondary release lever to effect pivoting of the plate by said secondary release lever.

9. A latch assembly as claimed in claim 8 wherein said plate has an aperture and said ratchet has a tab positioned to interengage with said aperture when said ratchet moves back to said primary closed condition.

10. A latch assembly as claimed in claim 9 wherein said housing has a stop for limiting movement of said secondary release arm when said secondary release arm is in said extended position.

11. A latch assembly as claimed in claim 10 wherein said secondary release arm extends substantially parallel to said housing when in said retracted position and extends substantially perpendicular to said housing when in said extended position.

* * * * *